United States Patent [19]

Pearce-Harvey et al.

[11] Patent Number: 4,843,528

[45] Date of Patent: Jun. 27, 1989

[54] ILLUMINATION LAMP APPARATUS

[75] Inventors: Peter R. Pearce-Harvey; Ernest V. Thomlinson, both of London; Raymond French, Rochester, all of England

[73] Assignee: Tasco Limited, London, England

[21] Appl. No.: 95,093

[22] Filed: Sep. 10, 1987

[30] Foreign Application Priority Data

Sep. 11, 1986 [GB] United Kingdom ..... 8621883

[51] Int. Cl.[4] ..... F21P 5/04

[52] U.S. Cl. ..... 362/277; 362/264; 362/293; 362/319; 362/373; 362/294; 353/35; 353/101

[58] Field of Search ..... 362/282, 283, 284, 321, 362/322, 324, 294, 293, 264, 210, 85, 373, 319; 353/101, 35

[56] References Cited

U.S. PATENT DOCUMENTS

| | | | |
|---|---|---|---|
| 1,835,176 | 12/1931 | Oberg et al. | 362/277 |
| 1,876,511 | 9/1932 | Oberg et al. | 362/277 |
| 2,076,240 | 4/1937 | Levy | 362/294 X |
| 2,950,382 | 8/1960 | Hatch | 362/294 X |
| 3,069,536 | 12/1962 | Dion et al. | 362/321 X |
| 3,477,781 | 11/1969 | Six | 353/25 X |
| 4,392,187 | 7/1983 | Bornhorst | 362/85 X |
| 4,460,943 | 7/1984 | Callahan | 362/319 X |
| 4,462,067 | 7/1984 | Altman | 362/277 X |
| 4,519,020 | 5/1985 | Little | 362/277 X |
| 4,697,227 | 9/1987 | Callahan | 362/233 |
| 4,701,833 | 10/1987 | Bornhorst | 362/373 X |

*Primary Examiner*—Albert J. Makay
*Assistant Examiner*—Carl D. Price
*Attorney, Agent, or Firm*—Fleit, Jacobson, Cohn, Price, Holman & Stern

[57] ABSTRACT

An illumination lamp including a frame formed of plastics material support boards (10–12) mounted in parallel relation perpendicular to the main axis of the lamp and spacers (14, 16) spacing said support boards from one another. Mounted on the frame is an illumination source (24), projecting a beam of light therefrom along the main axis of the lamp. A gobo disk (44) rotatable about an axis parallel to the main axis and includes a plurality of shaped apertures (52–57) distributed circumferentially of the gobo disk and selectively positionable in the beam; an iris (40) is mounted forwardly of gobo disk and a lens assembly (36) is mounted forwardly of the iris. The lens assembly (36) is moved so that its focal point is either accurately in the plane of gobo disk (44) or in the plane of the iris (40).

9 Claims, 4 Drawing Sheets

ILLUMINATION LAMP APPARATUS

The present invention relates to an illumination lamp apparatus of the type for producing a beam of light so that various illumination effects can be achieved.

It is quite common practice in popular music concerts, TV shows, films, etc and the like to have an elaborate illumination display to enhance the effects of the music. These are produced by illumination lamp apparatus which have to be controlled to give the desired effect. The known apparatus are fairly cumbersome and are usually mounted on an elaborate gantry and each has to be individually controlled from a central console via a remote link between the console and the individual lamp apparatus.

It is an object of the present invention to provided illumination lamp apparatus for such use.

It is now proposed, according to the present invention, to provide an illumination lamp apparatus comprising a frame and, mounted on said frame, an illumination source, beam producing means associated with said source for projecting a beam of light therefrom along a main axis of said apparatus, a shutter selectively to block said beam, a gobo disk rotatable about an axis parallel to said main axis and including a plurality of shaped apertures distributed circumferentially of said gobo disk and selectively positionable in said beam, an iris mounted forwardly of said gobo disk at a given spacing therefrom and along the line of said beam, a lens assembly mounted forwardly of said iris and means to move said lens assembly from a first position, in which its focal point lies on said main axis and in the plane of said gobo disk, and a second position, in which its focal point lies on said main axis and in the plane of said iris.

With such an apparatus one can readily utilise either the iris to give the controlled beam pattern emanating from the apparatus, in which case the gobo disk will be positioned with an aperture therein which gives free passage of the light therethrough without giving any shaping effect to the beam or, one can utilise the various aperture patterns of the gobo disk. With the apparatus of the present invention it is possible accurately to focus the lens assembly either on the iris so that a clear and sharp beam of light is produced by the iris of the desired diameter or, alternatively, one can leave the iris wide open and move the lens apparatus to the first position in which it is in focus with the plane of the gobo disk, so that each of the patterns produced by the relevant aperture or aperture array of the gobo disk is also in clear focus so that again a controlled sharp beam of the pattern of the selected apertures of the gobo disk is produced. It is a feature of this system that both gobo and iris may be operated for effect in conjunction with each other. Preferably the lens assembly is infinitely adjustable not only to be positionable in the two positions mentioned but also in any one of a large number of other positions.

In order to simplify the apparatus, and to make it lighter and therefore more managable, one can utilise, as the frame, two or more plastics material support boards mounted in parallel relation perpendicular to said main axis and means spacing said support boards from one another. The boards may be printed circuit boards carrying printed circuits thereon for use in the control of the operation of said apparatus.

With such a construction, not only is the apparatus generally made rather lighter because of the use of the support boards, but these support boards themselves can be very accurately machined, particularly if the plastics material is a fibreglass. Moreover, the wiring of the whole apparatus can be greatly simplified if one uses the support boards in the form of circuit boards and uses the circuits thereof for control rather than the use of a series of looms of wires which of necessity can readily become entangled with the other moving parts of the apparatus.

Preferably the gobo disc and iris are both mounted between said support boards. Sometimes it is advantageous to provide colouring effects and the apparatus may then further comprise at least one colour disk mounted on an axis parallel to said main axis and including a plurality of circumferentially spaced openings thereon, selectively positionable in said beam, said openings being adapted to receive coloured filters to alter the colour of the beam emanating from said lens assembly. The colour disks are preferably also mounted between said support boards.

It is essential to be able to control accurately the portions of the gobo disk, the iris and any colour disk or disks. For this purpose at least one of the support boards may carry thereon motors, controllable rotary potentiometers and gearing connected to said iris, said gobo disk, and said shutter and, where provided, to said colour disks, to enable said iris and shutter to be opened and shut, and to enable said gobo disk and said colour disks (where provided) accurately to be positioned with a selected one of said apertures or openings aligned with said beam.

The means to move the lens assembly may take many forms. However, in one preferred construction they comprise guides parallel to the main axis of the apparatus allowing movement of said lens assembly therealong, a ring gear supported for rotation about the axis of said lens assembly, by a plurality of circumferentially spaced pinions engaging with the ring gear, and threaded rods associated one with each of said pinions, said threaded rods each threadedly engaging apertures in said lens assembly, whereby, when said ring gear is rotated about the axis of the lens assembly, the pinions rotate and the threaded rods rotate to cause the lens assembly to move axially.

According to a further aspect of the invention there is provided an illumination lamp apparatus comprising a frame formed of at least two plastics material support boards mounted in parallel relation perpendicular to the main axis of the apparatus and means spacing said support boards from one another and, mounted on said frame, an illumination source, beam producing means associated with said source for projecting a beam of light therefrom along the main axis of said apparatus, a shutter located to block said beam, a gobo disk rotatable about an axis parallel to said main axis and including a plurality of shaped apertures distributed circumferentially of said gobo disk and selectively positionable in said beam, an iris mounted forwardly of said gobo disk and a lens assembly mounted forwardly of said iris.

In order that the present invention may more readily be understood, the following description is given, merely by way of example, reference being made to the accompanying drawings, in which.

Figure 1:
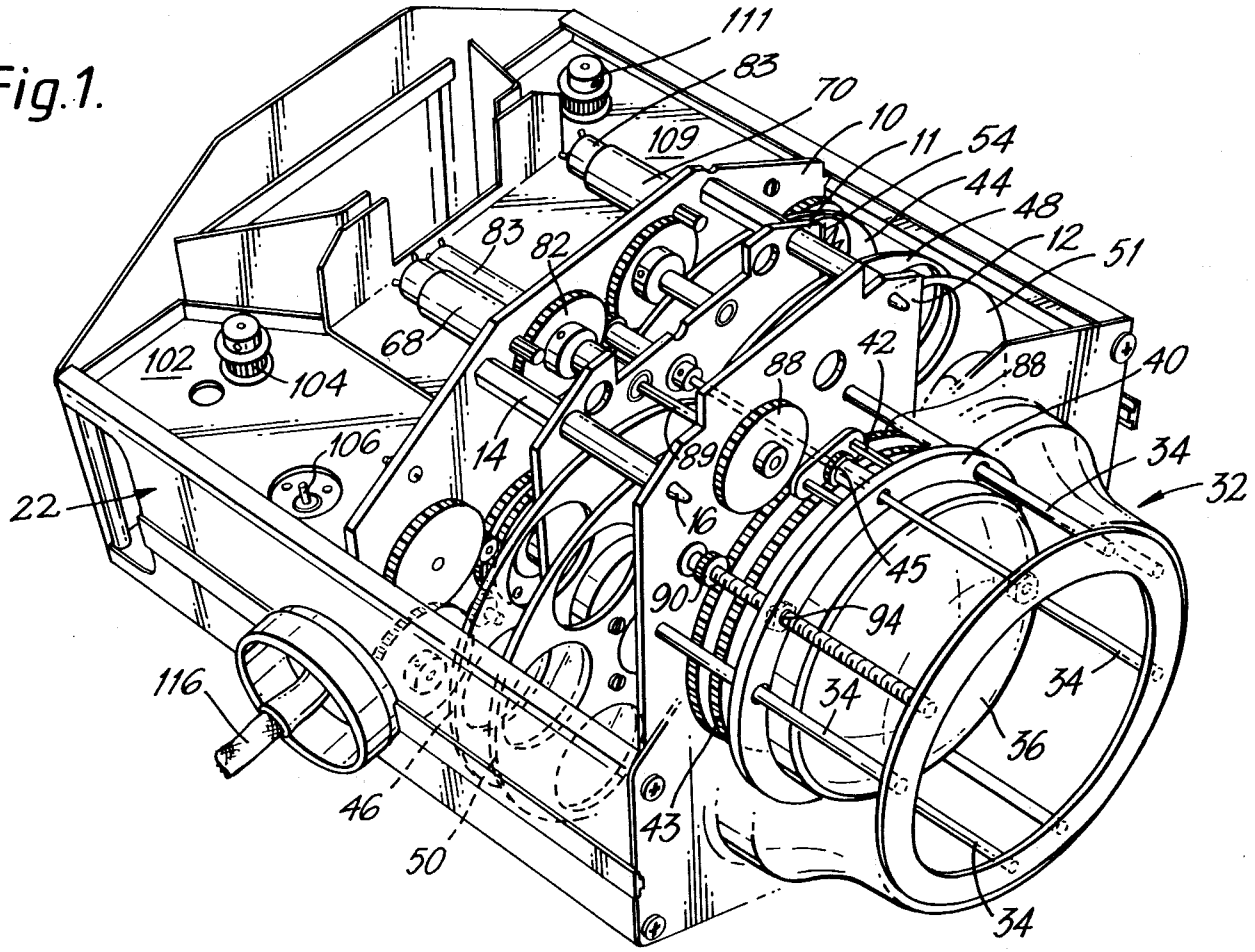
FIG. 1 is a perspective, schematic view of one embodiment of the apparatus according to the present invention.

In FIG. 1 there is illustrated one embodiment of apparatus according to the present invention which will normally be mounted in a cradle allowing pivoting about both a vertical axis and a horizontal axis. Such a cradle is of a well known type and a further description of it is not believed to be necessary herein.

The apparatus itself comprises a frame formed by three fibreglass support boards 10, 11, 12 these being spaced apart from one another by metal spacers 14 with associated securing bolts 16. One or more of the support boards 10, 11, 12 may carry printed circuit elements (not shown) of a conventional nature.

Mounted rearwardly of the support board 10, (FIG. 5) is a rear sub-frame 22 carrying a source of illumination 24 provided with a beam producing reflector (not shown) adapted to project a beam of light along the main axis 28 of the apparatus. The source 24 and reflector are purely conventional and can be removably mounted in the sub-frame 22 for ready replacement. The sub-frame 22 also carries, on spaced pivots 30 openable and closable shutters 26 operable by a motor 29 which are intended to enable the beam of light to be blocked.

Mounted in front of the forward support board 12 is a front sub-frame 32 having four forwardly extending guide rods 34 parallel to the axis 28. These carry a conventional lens assembly 36 which can be moved back and forth a short distance as indicated by the arrows 38 and as will be described in more detail later. The lens assembly may include a simple lens or may include several lenses, at least one of which may be individually adjustable relative to one another to alter the focal length of the assembly.

Figure 3:
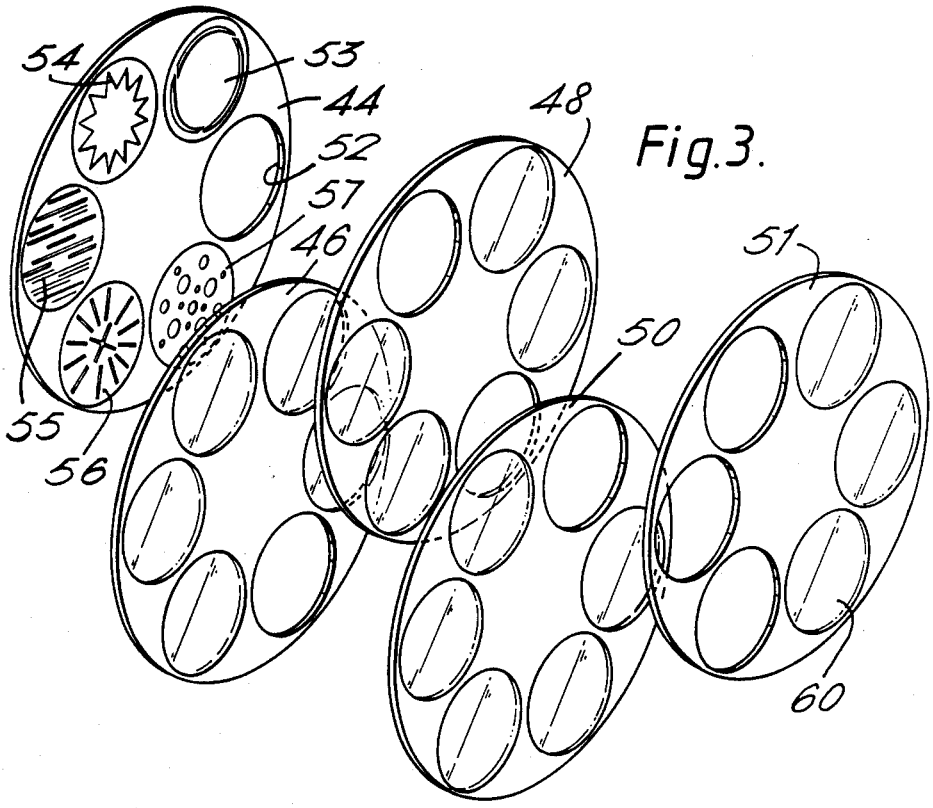
FIG. 3 is a perspective, schematic view of the gobo disk and colour disks.
Figure 4:
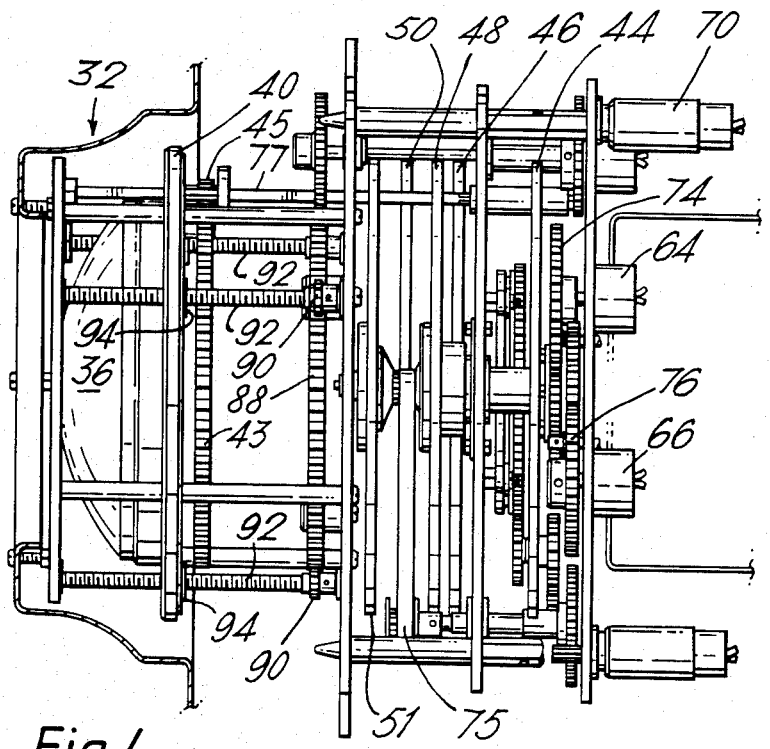
FIG. 4 is a side elevation of the center part of the apparatus, as viewed from the other side as compared with FIG. 1.

Mounted between the support boards 11, 12 and as can be seen more clearly from FIG. 4 is firstly, and near to the circuit board 12, an iris 40 which can be opened and shut by a lever 42 mounted on a ring gear 43, which in turn is mounted on pinions 45 one of which can be seen in FIG. 1. Mounted rearwardly of the iris 40 is a gobo disk 44 which is spaced from the plane of the iris itself by a given distance, in one particular embodiment 7 millimeters. Positioned forwardly of the gobo disk are four colour disks 46, 48, 50, 51. As can be seen from FIG. 3, the gobo disk 44 is provided, at circumferentially spaced locations, with several apertures. The first aperture 52 is a purely circular aperture of approximately the same size as the fully opened iris 40. The remaining apertures 53 to 57 are provided with different shaped holes, cut-outs and slots. Each colour disk 46, 48, 50, 51 is provided with six circumferentially spaced openings 60 into which can be positioned coloured or interference filters, these being retained in place by spring clips (not shown). The gobo disk can be formed in the same way, to enable slides with different aperture configurations to be substituted to give a desired effect.

Figure 2:
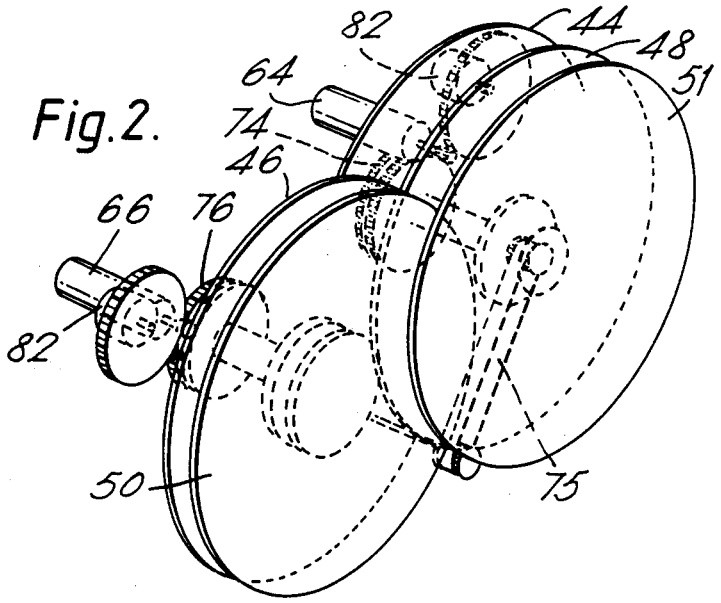
FIG. 2 is a perspective, schematic view of the gobo disk and colour disks of the apparatus of FIG. 1 showing the various drive motors and gearing.

FIG. 2 illustrates again the positioning of the various disks and how the disks 44, 46, 48, 50, 51 are each driven by a separate motor, only two of which have been shown for clarity, the motors being mounted on support board 10. Drive from the motors is effected via gear trains shown schematically at 74 and 76. The drive to the front colour disk 51 is also via a belt 75. The control of each of the motors is effected remotely via a separate rotating potentiometer for each motor, these being arranged to seek particular selected positions of the various disks to give the desired pattern. Only two of these are shown at 83.

Figure 5:
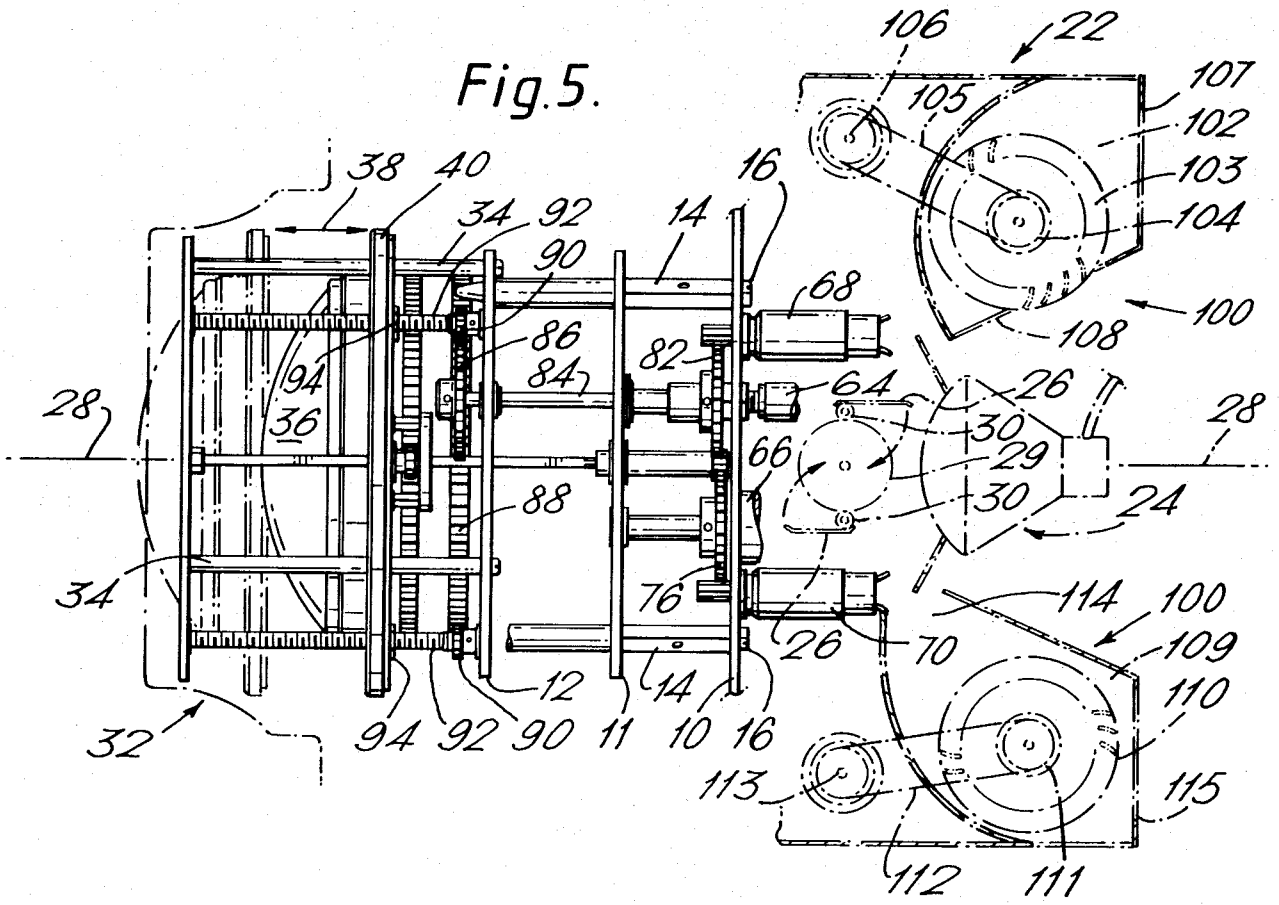
FIG. 5 is a plan view of the portion shown in FIG. 4, with many parts omitted for clarity, and also showing the source of illumination and its cooling means at the rear part.

An additional motor 68 also drives, via a further gearing 82 a shaft 84 which carries, a pinion 86 engagable with a ring gear 88 this being engagable with further pinions 90 (FIG. 5). If reference is again made to FIG. 1 is can be seen that the pinions 90 are each associated with a threaded rod 92 each of which is threadably engaged in an aperture 94 carried by the front sub-frame 22. With such an arrangement, when the motor 68 is actuated to bring the aperture 52 into alignment with the main axis 28 of the apparatus, the pinion 86 rotates and rotates the ring gear 88, and the pinions 90 and the threaded rods 92 thereby pushing the lens assembly 36 to its forward position as indicated by the arrow 38 and as shown in phantom in FIG. 1. In this position the focal point of the lens assembly is on the axis 28 and in the plane of the iris 40.

A further motor 70 drives a gear train 76 and thus a drive shaft 77 which is connected to pinion 45 to rotate ring gear 43 to open and shut the iris 40. Motors 68 and 70 are also controlled by separate rotary potentionmeters.

The arrangement is such that the lens assembly 36 can be moved to a rear position in which the focal point of the lens assembly is on the axis 98 and in the plane of the gobo disk 44, so that any of the patterns produced by the apertures 54, 56, 58 will be properly focused.

At the rear of the apparatus there is provided ducting 100 including a first housing part 102 in which is mounted a cylindrical or tangential flow fan 103. A pulley 104 on the axis of this fan is driven via a belt 105 by a motor 106 and air is drawn in at 107 and discharged towards the light source 24 through an outlet 108. A second housing 109 is provided with a similar fan 110 which is driven by a pulley 111, drive belt 112 and motor 113. This second fan draws air from the source 24 through inlet 114 and discharges via outlet 115. An electrical supply cable 116 for the apparatus is shown in FIG. 1.

It will be appreciated that such a construction is very simple and compact as a result of use of the circuit boards as the main components of the frame of the apparatus and enables either a gobo disk or an iris to be accurately in focus and this can readily be controlled remotely.

We claim:

1. An illumination lamp apparatus comprising:

a frame, an illumination source mounted on said frame, beam producing means mounted on said frame and associated with said source for projecting a beam of light from said illumination source along a main axis of the apparatus, a shutter mounted on said frame and being selectively movable to block said beam of light, a gobo disk mounted on said frame forwardly of said illumination source in the direction of said beam of light and being rotatable about an axis extending parallel to said main axis and including a plurality of shaped apertures distributed circumferentially about said gobo disk, said shaped apertures being selectively positionable in said beam of light, an iris mounted on said frame forwardly of said gobo disk in the direction of said beam of light, said iris extending in a plane at a predetermined spacing from said gobo disk along said main axis of said beam of light, a lens assembly mounted for movement along a lens axis on said frame forwardly of said iris in the direction of said beam of light for creating a focal point of said beam of light, controllable mechanically operable means for moving said lens assembly physically and selectively as a whole from a first position where said focal point of said lens assembly lies on said main axis and in the plane of said gobo disk, and a second position where said focal point of said lens assembly lies on said main axis and in the plane of said iris, said means for moving said lens assembly including:

guides extending parallel to said main axis of the apparatus to allow movement of said lens assembly therealong, a ring gear rotatable about the lens axis of said lens assembly, a plurality of circumferentially spaced pinions engaging with and supporting said ring gear for rotation, threaded rods associated one with each of said plurality of circumferentially spaced pinions, and threaded apertures in said lens assembly, each threaded aperture threadingly engaging said threaded rods so that when said ring gear is rotated about the lens axis of said lens assembly, said plurality of circumferentially spaced pinions rotate and said threaded rods rotate to cause said lens assembly to move axially along said main axis.

2. Apparatus as claimed in claim 1, wherein said frame comprises at least two rigid plastics sheet material support boards mounted in parallel relation perpendicular to said main axis and means for spacing said support boards from one another.

3. Apparatus as claimed in claim 2, wherein said gobo disk and said iris are mounted between said support boards.

4. Apparatus as claimed in claim 1, and further comprising at least one color disk mounted on an axis parallel to said main axis , said color disk including a plurality of circumferentially spaced openings thereon, said openings being selectively positionable in said beam, and colored or interference filters received in said openings effective to alter the color of the beam emanating from said lens assembly.

5. Apparatus as claimed in claim 4, wherein said color disks are mounted between said support boards.

6. Apparatus as claimed in claim 4, and further comprising, and mounted on said support boards, motors and controllable potentiometers, connected to said motors, and gearing connected to said iris, said gobo disk, and said shutter and to said color disks, to enable said iris and shutter to be open and shut, and to enable said gobo disk and said color disks to be positioned with a selected one of said apertures or openings aligned with said beam.

7. Apparatus as claimed in claim 1, and further comprising a motor and a controllable rotary potentiometer and wherein said ring gear is rotated by a further motor.

8. Apparatus as claimed in claim 1, and further comprising a second ring gear mounted forwardly of said ring gear and another motor and controllable potentiometer, wherein said second ring gear is driven by said another motor and means on said second ring gear to cause opening and shutting of said iris.

9. Apparatus as claimed in claim 1 and further comprising ducting associated with said illumination source, and at least one tangential fan mounted to pass air through ducting to cool said illumination source.

* * * * *